US006027287A

United States Patent [19]

Faldini

[11] Patent Number: 6,027,287

[45] Date of Patent: Feb. 22, 2000

[54] SYSTEM AND PROCEDURE TO TRANSFER A LOAD FROM A CARGO BARGE TO A SUBSTRUCTURE

[75] Inventor: Roberto Faldini, Cernusco sul Naviglio, Italy

[73] Assignee: Saipem S.p.A., Milan, Italy

[21] Appl. No.: 08/898,437

[22] Filed: Jul. 22, 1997

[30] Foreign Application Priority Data

Jul. 26, 1996 [IT] Italy ..... MI96A1569

[51] Int. Cl.[7] ..... E02D 25/00; E02B 17/08; B63B 35/40

[52] U.S. Cl. ..... 405/209; 405/204

[58] Field of Search ..... 405/204, 209, 405/203, 195.1, 205, 206, 207

[56] References Cited

U.S. PATENT DOCUMENTS

| | | | |
|---|---|---|---|
| 4,436,454 | 3/1984 | Ninet et al. | 405/204 |
| 4,607,982 | 8/1986 | Brasted et al. . | |
| 4,662,788 | 5/1987 | Kypke et al. | 405/204 |
| 4,761,097 | 8/1988 | Turner . | |
| 4,848,967 | 7/1989 | Weyler . | |
| 4,930,938 | 6/1990 | Rawstron et al. | 405/204 |
| 5,219,451 | 6/1993 | Datta et al. | 405/209 X |
| 5,522,680 | 6/1996 | Hoss et al. | 405/209 |

FOREIGN PATENT DOCUMENTS

| | | | |
|---|---|---|---|
| 0 654 564 | 5/1995 | European Pat. Off. . | |
| 1.601.016 | 9/1970 | France . | |
| 001511330 | 9/1989 | U.S.S.R. | 405/209 |
| 2022662 | 12/1979 | United Kingdom | 405/209 |
| 2 176 827 | 1/1987 | United Kingdom . | |

OTHER PUBLICATIONS

G. J. White, et al., "Offshore Installation of an Integrated Deck Onto a Preinstalled Jacket", Offshore Technology Conference, vol. 3, pp. 321–330.

Patent Abstracts of Japan, vol. 10, No. 44, (M–455),Feb. 21, 1986 & JP 60–195216, Oct. 3, 1985.

*Primary Examiner*—Dennis L. Taylor

*Attorney, Agent, or Firm*—Oblon, Spivak, McClelland, Maier & Neustadt, P.C.

[57] ABSTRACT

A system transfers, at sea, a load onto fixed legs of a substructure emerging from water. The load is specially fabricated in the construction yard and is transported to the substructure by a suitable cargo barge. The load and the substructure have a corresponding number of legs. The transfer system includes a preload mooring subsystem in front of the substructure. A horizontal sheave can be opened and is used to shift a mooring wire from one position to another. The transfer system also includes a subsystem to mate the load to the substructure. This mating subsystem has a main transfer or extender, called an ALS, installed on legs of the load. Also, the mating subsystem has a secondary transfer or cargo barge release, called a BRS, installed on the cargo barge. Furthermore, the transfer system includes a subsystem to protect the barge sides and the legs of the substructure. Finally, the transfer system includes a cargo barge arrest subsystem.

11 Claims, 20 Drawing Sheets

3/A
3/B
3/C
3/D
8a
3
4
150m
1
9
8
8b
10
2
7
5
6

2
35
33
34
37
31
21/a
21/a
21/a
21/a
21/b
21/b
30
39
41
40
42
43
32
3

Fig.11a
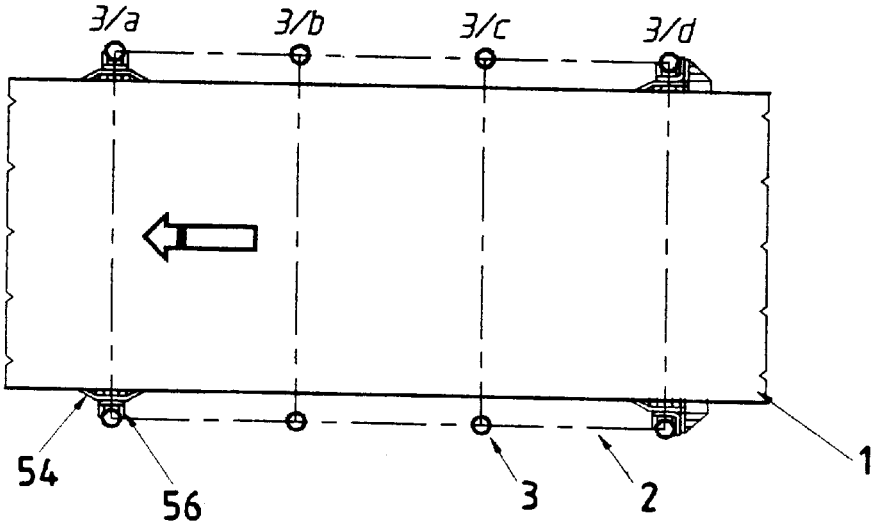
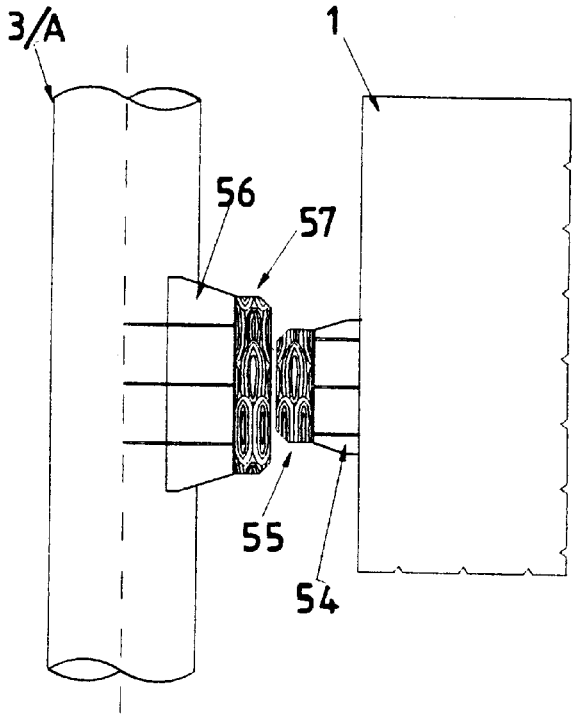
Fig.11c
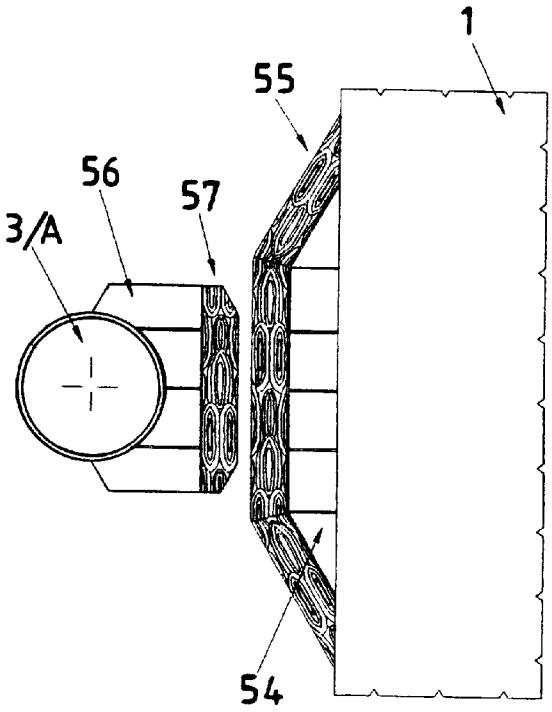
Fig.11b

SYSTEM AND PROCEDURE TO TRANSFER A LOAD FROM A CARGO BARGE TO A SUBSTRUCTURE

BACKGROUND OF THE INVENTION

1. Field of the Invention

The present invention relates to a system and procedure to transfer a load from a cargo barge to a substructure. More particularly, the present invention relates to a system and procedure to transfer, at sea, a load on the fixed legs emerging from water of a substructure, said load specially fabricated in the construction yard and transported to said substructure by a suitable cargo barge.

2. Description of the Related Art

In the state of the art, other systems are already known to transfer at sea loads from cargo barges to platforms. The transfer has been performed, until now, by lifting the load to be transferred by middle/big pontoons or crane vessels, subdividing said loads in multiple modules depending on the weight of the load to be lifted. This well known method has however always required the operator to maintain the loads to be transferred within preestablished limits due to many problems among which, first of is the availability of middle/big pontoons or crane vessels and their cost which is indeed very expensive.

Many other methods have been known in the art. One of the most recent is that one reported, for example, by W. D. Martell and S. M. Beattie of Enercon Eng. Inc. on: "Integrated float-over deck design considerations" which was presented at the Offshore Technology Conference, O.T.C. 8119, held in Houston, Tex., from 6 to May 9, 1996. There the authors detailed the installation of two large modules by the transfer from a cargo barge to a substructure in the South China Sea (M-Field) for Shell Sarawak.

This installation has required the mooring of a cargo barge, suitably prepared with an integrated module therein charged, inside the opening of a substructure fixed to the bottom of the sea. The structure emerges from the sea level with two towers having four legs each; the subsequent lowering of the cargo barge is made by ballast pumped inside the transport vessel, in order to transfer gradually the weight of the load from the cargo barge to the substructure.

This experience has shown, even to the participants at the installation, the real possibility to transfer big loads at sea world wide, assuming that the significant wave height and the relevant impact value between cargo barge side and substructure legs, remain within preestablished and acceptable values.

SUMMARY OF THE INVENTION

The invention is a simple system and method, fast and safe, which provides the opportunity to transfer, at sea, a load from a cargo barge to a substructure unlike the aforementioned system, the invention combines active and passive action of components, thus accelerating, in this way, the transferring time.

The present invention therefore provides a system to transfer, at sea, a load onto the fixed legs of a substructure emerging from water, said load specially fabricated in the construction yard and transported to said substructure by a suitable cargo barge, said load and substructure having a corresponding number of legs, said system comprising:

(a) a prelaid mooring system in front of the substructure emerging from water comprising:

(a') a horizontal sheave that can be opened and used to shift a mooring wire from one position to another;

(b) a system to mate said load to the substructure comprising:

(b') a main transfer system or extension system, called ALS, installed on the load legs;

(b") a secondary transfer system or cargo barge release system, called BRS, installed on the cargo barge;

(c) a system to protect the barge sides and the substructure legs; and (d) a cargo barge arrest system.

In the present invention, a load is called any kind of structure, integrated module or deck, suitably built in a construction yard; meanwhile, a structure is called any kind of structure, fixed or anchored to the sea bottom.

In the present invention, a cargo barge is any kind of floatable means properly prepared to transport said load. The cargo barge is equipped with an adequate ballasting system well known to those skilled in the art.

The main transfer system ALS (b') is useful for the aim of the present invention and is characterized by:

($b'_1$) a special joint on the load legs;

($b'_2$) an actuated leg slidable inside the load legs with a special joint at the lower extremity for mating with the substructure legs; and ($b'_3$) a variable number of hydraulic jacks, said hydraulic jacks being present in proportional number with respect to the weight of said load.

The secondary transfer system BRS (b") is also useful for the aim of the present invention and is characterized by:

($b''_1$) two support plates on which sits the load for transport, said support plates being hinged in the inner part for automatic release;

($b''_2$) a damping rubber or resilient material as, for example, polyurethane or elastomers, on the internal part of the support plates ($b''_1$);

($b''_3$) an hydraulic jack placed on a support plate; and ($b''_4$) a sand hopper ending with an adequate opening with a valve for the rapid flow-out of the sand on top of which are placed the hydraulic jack and support plate ($b''_3$).

The system (c), which is provided to protect, locally or totally, the cargo barge sides and the substructure legs, and also to damp the impact caused by the wave between the cargo barge and the substructure legs, is constituted by hard timber or any other material suitable to absorb any impact loads. The cargo barge arrest system (d) is composed of hard timber or any other material suitable to absorb any impact loads. The systems (c) and (d) permit, jointly, the automatic alignment of the load legs on the cargo barge with the substructure legs (mooring mating of the cargo barge).

There falls within the aim of the present invention a procedure, based on the afore-mentioned system, to transfer, at sea, a load on the fixed legs of a structure emerging from water, said load specially fabricated in the construction yard and transported to said substructure by a suitable cargo barge. The procedure requires the operator:

(1) to maneuver the cargo barge on which, in the construction yard, the load has been properly transferred and seafastened in the final transportation configuration, on the preinstalled grillage, inside the slot of the substructure, in such a way that the alignment of the load legs and the substructure legs is automatic;

(2) to activate the hydraulic jacks ($b'_3$) in such a way that, the activated leg slidable inside the load legs ($b'_2$) mate the substructure legs by closing the hydraulic circuit so that the load weight will be transferred partially to the substructure;

(3) to activate the ballasting system on the cargo barge while the hydraulic jack on the support plate ($b''_3$) is raised jointly with the hydraulic jacks ($b'_3$), in such a way so as to release the support plates ($b''_1$), on which sits the load, thereby entering the "nonreturn-point" of the whole operation;

(4) to open the opening by way of a valve for the flow-out of the sand hopper ($b''_4$), jointly with the raising of the hydraulic jacks ($b'_3$) in such a way to transfer all the weight of the load on the substructure legs, taking care of keeping the ballast system on the cargo barge always running in such a way of further lowering the cargo barge in order to have a safer exit from the substructure of the platform;

(5) to lower totally, once the cargo barge is out of the substructure slot, the hydraulic jacks ($b'_3$) on the substructure legs; and (6) to remove the hydraulic jacks ($b'_3$) jointly with the hydraulic circuit and weld the bevels of the platform legs.

At the end of step (5) of the procedure disclosed above, once the cargo barge is out of the substructure slot, said cargo barge is unmoored and returned to the shore-yard. Meanwhile, the mooring system is recovered. Through the step (2), the hydraulic jacks ($b'_3$) stroke will be as much as is necessary to assure the partial transfer of the load to the substructure.

BRIEF DESCRIPTION OF THE DRAWINGS

The advantages of the present invention will be better understood by referring to the following detailed description of the attached drawings in which the FIGS. 1 to 12 represent:

FIG. 3/*a*: is a side elevation view of the horizontal sheave that can be opened;

FIG. 3/*b*: is a left side elevation view of the horizontal sheave that can be opened;

FIG. 3/*c*: is a right side elevation view of the horizontal sheave that can be opened;

FIG. 3/*d*: is a top plan view of the horizontal sheave that can be opened;

FIG. 4/*a*: is the elevation view, Solution B, showing the substructure/load in the mating configuration;

FIG. 5/*a*: is the activated leg in the 4000-ton typical extended configuration (ALS);

FIG. 5/*b*: is the activated leg in the 2000-ton typical extended configuration (ALS);

FIG. 5/*c*: is the activated leg, solution A (ALS);

FIG. 5/*d*: is the activated leg, solution B (ALS);

FIG. 5/*e*: is the activated leg, solution C (ALS);

FIG. 8/*a*: is the detailed cargo barge release system (BRS);

FIG. 11/*a*: is a general view of the mating alignment side fender;

FIGS. 11/*b*, 11/*c*: are enlarged views of the details of the mating alignment side fender;

FIGS. 12/*b*, 12/*c*: are enlarged views of the details of the mating alignment fender and stopper.

The FIGS. 1–12 refer to a preferred embodiment of the present invention: therefore, it has to be intended that the invention is not limited by said FIGS. 1–12. On the contrary, it is intended to cover all the alternatives, modifications and equivalents, which could be included in the spirit and aim of the present invention.

DETAILED DESCRIPTION OF THE PREFERRED EMBODIMENTS

Figure 1:
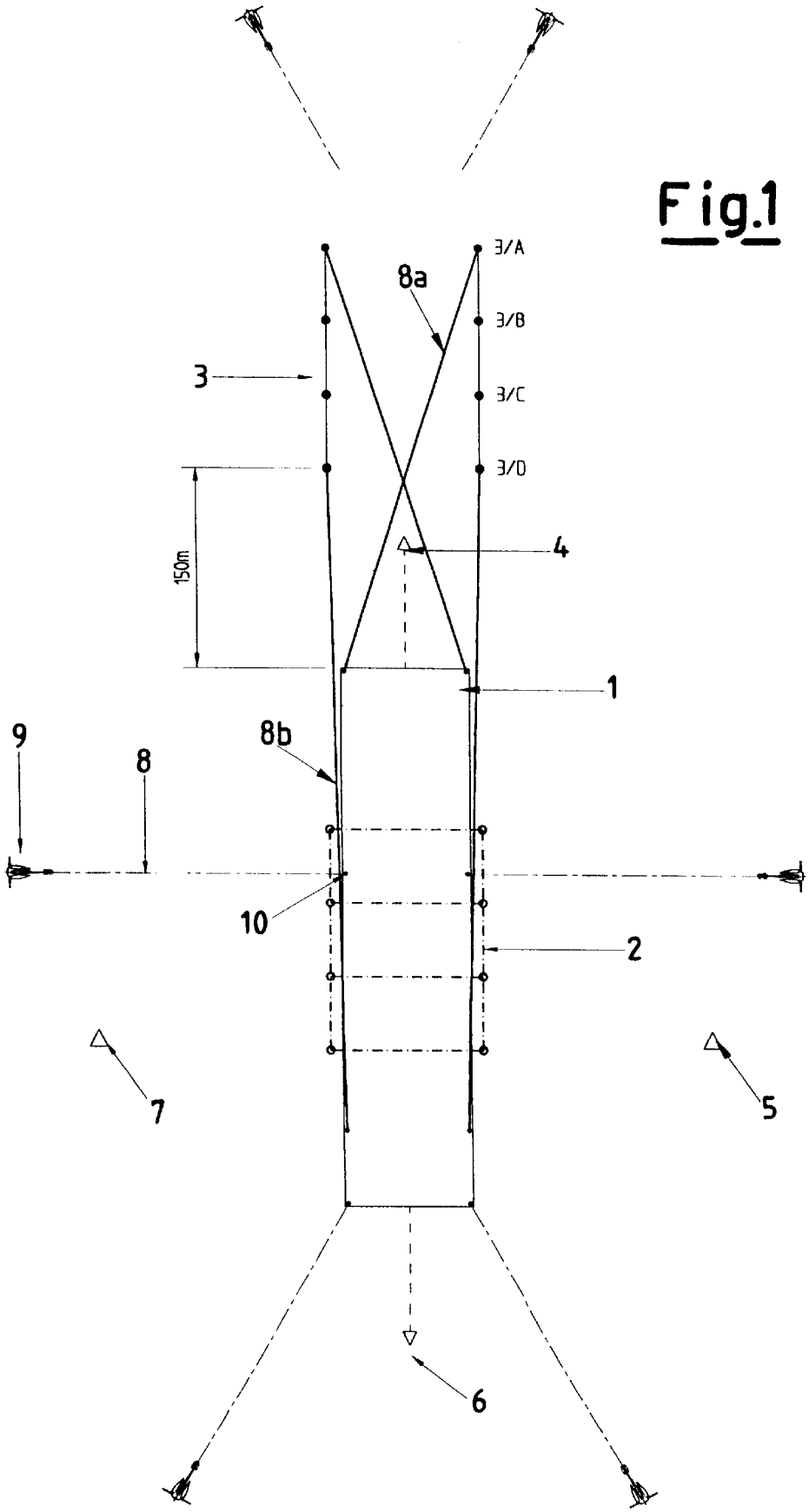
FIG. 1: is the cargo barge mooring waiting configuration.

Referring now to the drawings exhaustively, FIG. 1 shows a mooring waiting configuration of a cargo barge 1 with a load 2 set on the longitudinal axis of the cargo barge, moored in front of a substructure 3 by a series of mooring wires 8 and anchors 9, some nylon wires 8*a* connected to the substructure outer legs 3/A and two steel wires (with nylon stretcher) 8*b* connected to the substructure inner legs 3/D.

The mooring steel wires 8 with their respective anchors 9, have been prepared in advance by the common offshore art and then connected to the mooring steel wires 8*b* coming from the cargo barge.

Leading tugs 4 and 6 are employed during the whole operation and are considered as a backup to the mooring system.

Steering tugs 5 and 7 are used both for handling mooring wires 8 and anchor 9 and as a backup to the mooring system.

A hinged horizontal sheave 10 can be opened and will be analysed, in detail, later.

Those persons skilled in the art will recognise that the cargo barge 1 may be any floatable means and the load 2 may be set on the transversal axis; meanwhile, the mooring system represented by the items 8, 8*a*, 8*b* and 9, and the distance of the cargo barge 1 from the substructure 3, may vary depending upon the environmental conditions of the installation site.

Figure 2:
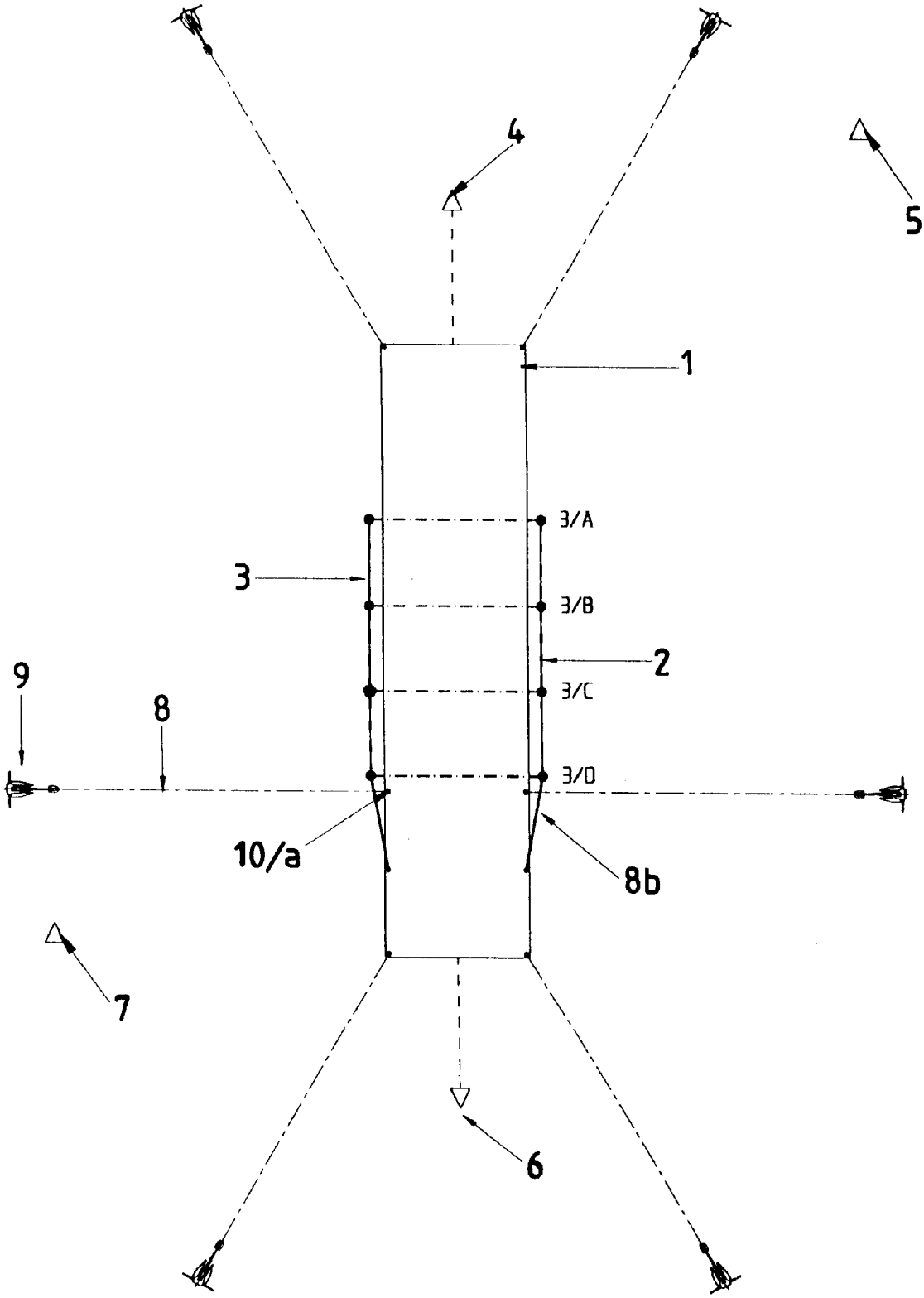
FIG. 2: is the cargo barge mooring mating configuration.

Analysing now FIG. 2, where the mooring mating configuration is illustrated, the cargo barge 1 has been maneuvered inside the slot of the substructure 3, in order to have automatically the alignment between the legs of the load 2 and the substructure 3. The automatic alignment will be analysed, in detail, later.

The mooring wire 8, which before was passing through the hinged horizontal sheave 10/*a* that can be opened, is now passing through a normal horizontal sheave, which is well known to those skilled in the art.

FIGS. 3/*a*, 3/*b*. 3/*c* and 3/*d* illustrate the hinged horizontal sheave that can be opened in which its hinged part 10 is supported by the fixed part 13. The hinged sheave allows the mooring wire 8 to be shifted instantly from the middle-fore sides of the barge 1 to the middle-aft sides.

Figure 3A:
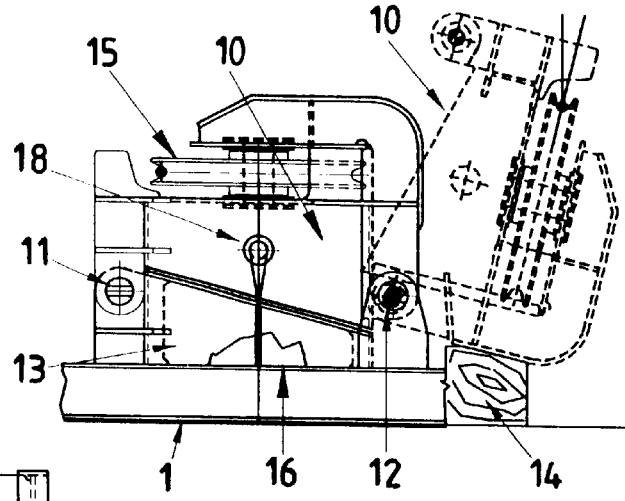
FIG. 3: is the horizontal sheave that can be opened.
Figure 3B:
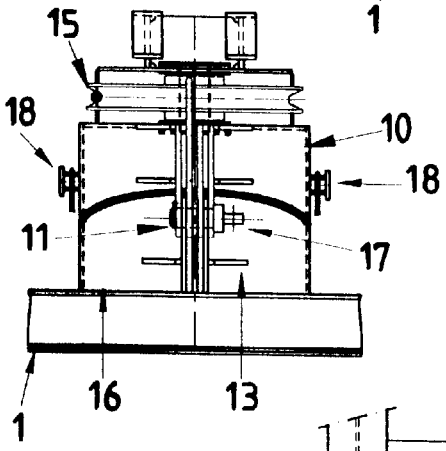
Figure 3C:
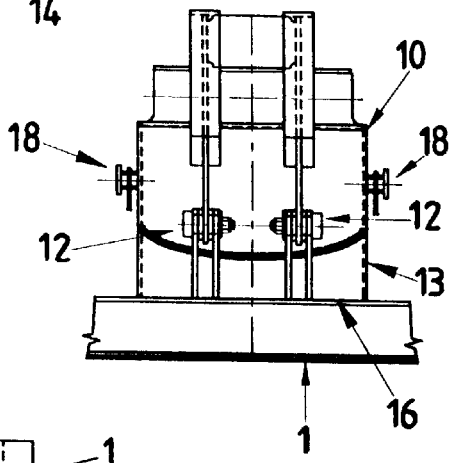

It will be apparent, to those skilled in the art, that the position of the hinged horizontal sheave 10 that can be opened, may vary according to the necessity of the case. By way of common offshore art, as seen in FIGS. 3*a* and 3*b*, the mooring wire 8 is passed through a sheave 15 of the hinged part 10. All the assembly is welded out on a suitable grillage 16 fixed on a deck of the barge 1. Two lifting pins 18 are used to position the assembly.

The hinged part 10 is secured to the fixed part 13 by a removable pin 11 and two fixed pins 12.

Figure 3D:
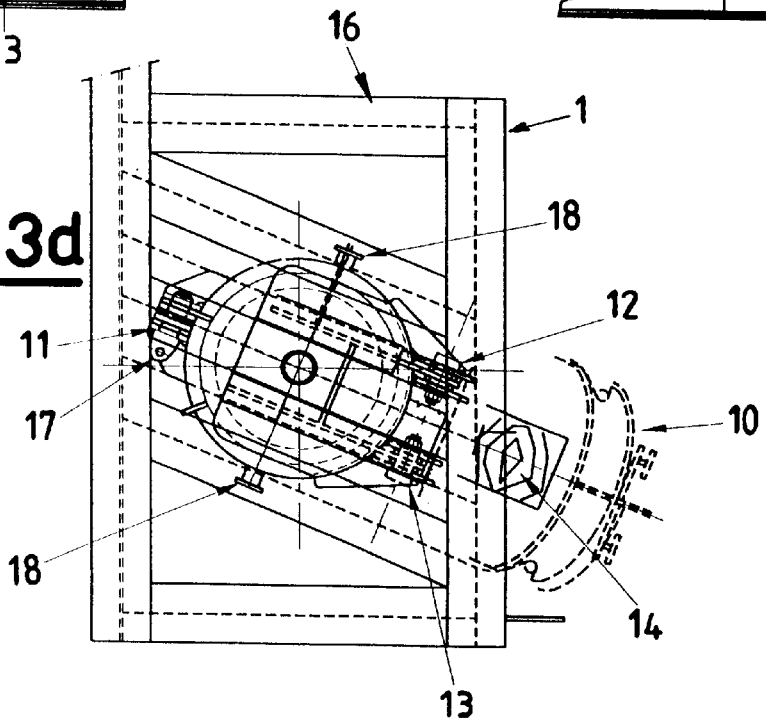

The removable pin 11 has a padeye 17, seen in FIGS. 3*b* and 3*d*, where a pulling steel wire, coming from a winch or a chain block or any other pulling means known to those skilled in the art, is connected.

When the mooring wire 8 is close to the inner substructure legs, the pulling wire is activated in order to disengage the removable pin 11.

The hinged part 10 will raise automatically in order to make the mooring wire 8 pass to position 10/*a* (see FIG. 2) through a conventional horizontal sheave.

An impact absorber 14 is covered with hard timber, fixed on the deck of the cargo barge 1, in order to safeguard the integrity of the cargo barge 1 and of the hinged part 10.

Figure 4:
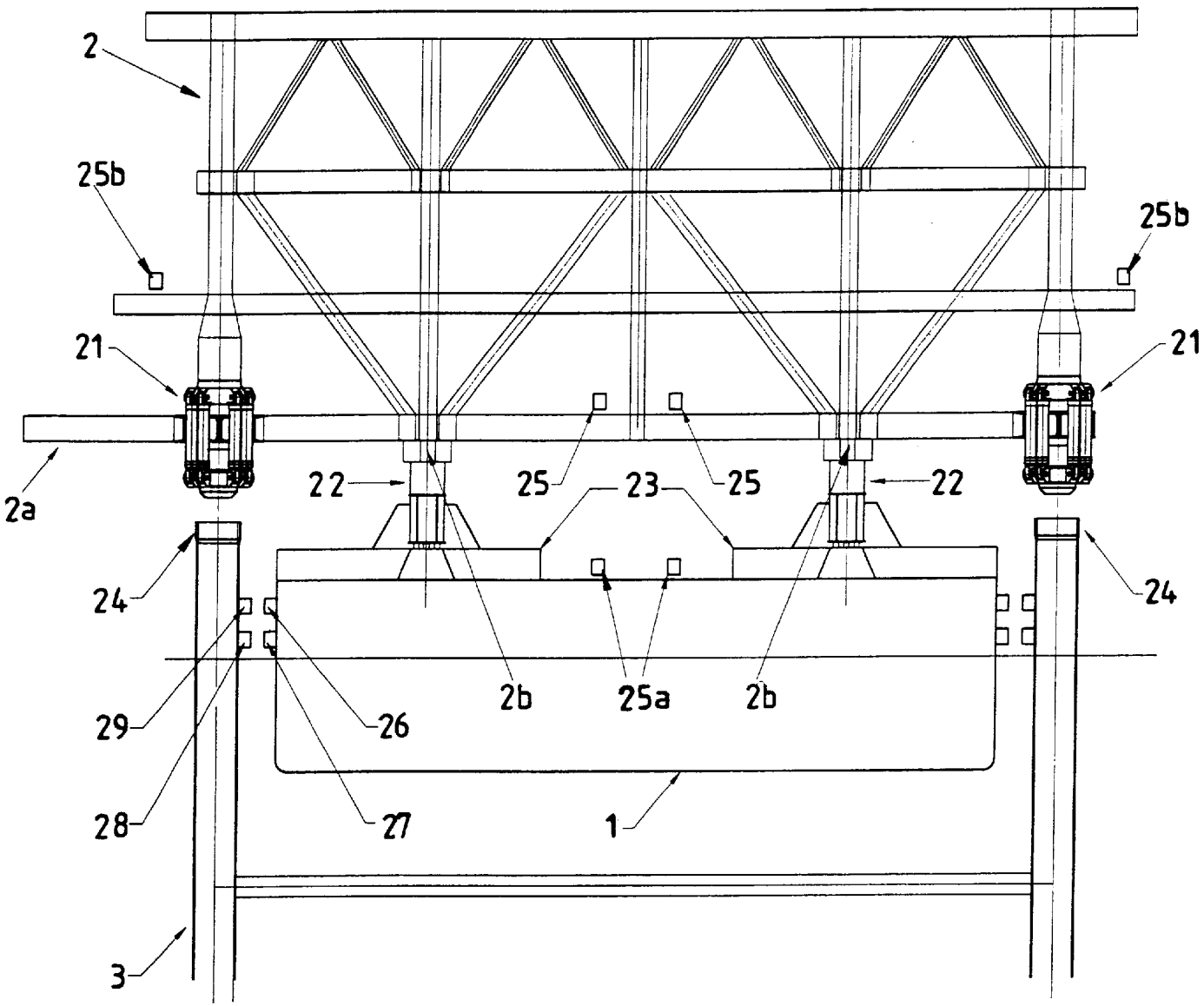
FIG. 4: is the elevation view, Solution A, showing the substructure/load in the mating configuration.
Figure 4A:
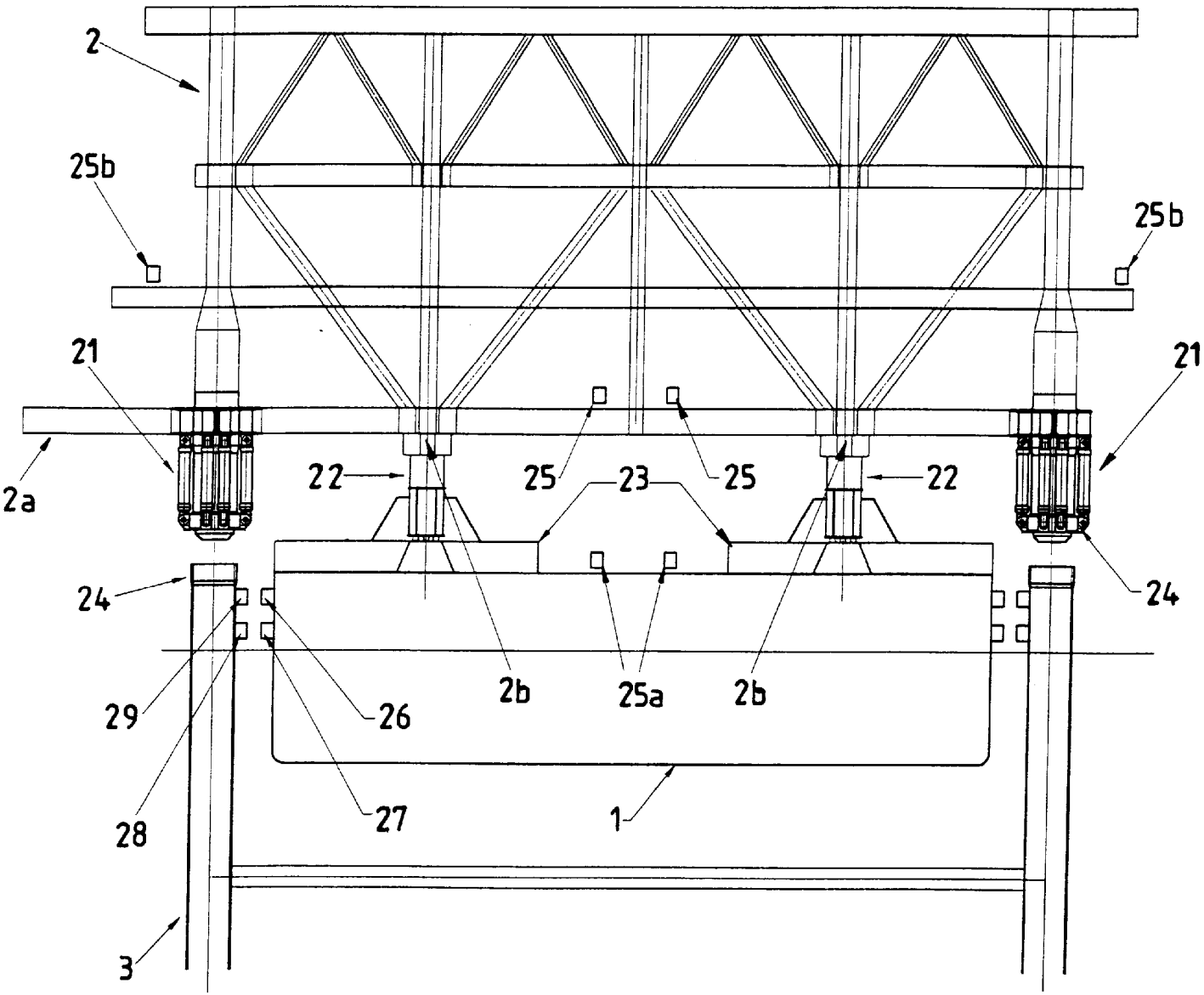

FIG. 4 illustrates the load 2 on the cargo barge 1 inside a slot of the substructure 3 fixed or anchored to the sea bottom. The cargo barge 1 underlies the main components of the present invention: the main transfer system (ALS) 21 fixed to the cellar deck main frame 2*a* (solution A); the secondary transfer system (BRS) 22; the grillage 23 for the seafastening of the cargo barge 1; the support plate 24 inside the legs of the substructure 3 fixed at a predetermined height; the hydraulic power pack 25 for the ALS jacks; the hydraulic power pack 25*a* for the BRS jack; the accumulator 25*b* for the ALS; the local fendering system 26 and 27 on the cargo barge sides; and the fendering system 28 and 29 on inner and outer substructure legs.

FIG. 4/*a* illustrates the structural solution of the ALS 21 fixed underneath the cellar deck main frame 2*a* (solution B).

Figure 5:
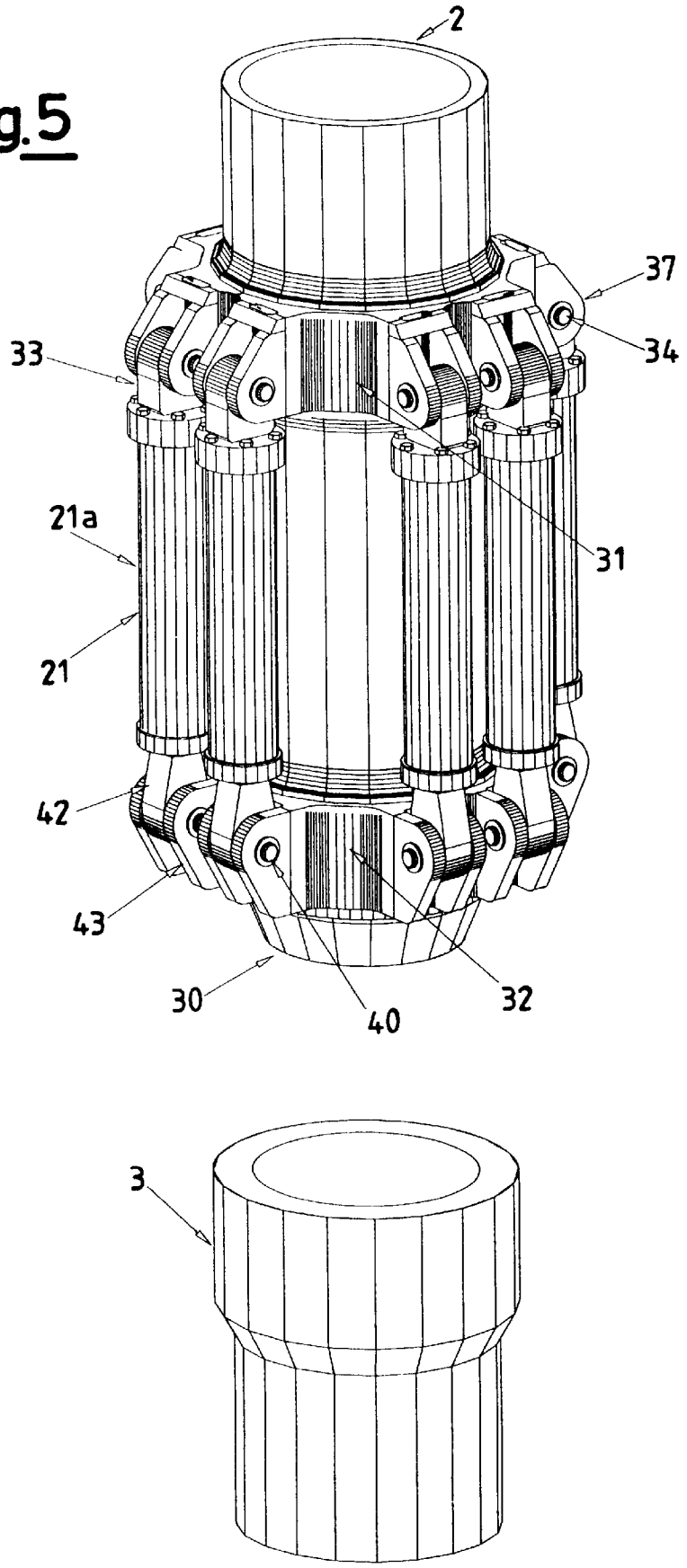
FIG. 5: is the activated leg in the 4000-ton typical retracted configuration (ALS)

FIG. 5 depicts the typical retracted 4000-ton configuration of the ALS 21, where there are, respectively, the load 2, a leg of the substructure 3, the actuated leg 30 slidable inside the load leg, and the special joint 31 which is part of the load 2. The upper part 33 of the hydraulic jack 21*a* is connected to the padear 37 by the pin 34.

Figure 5A:
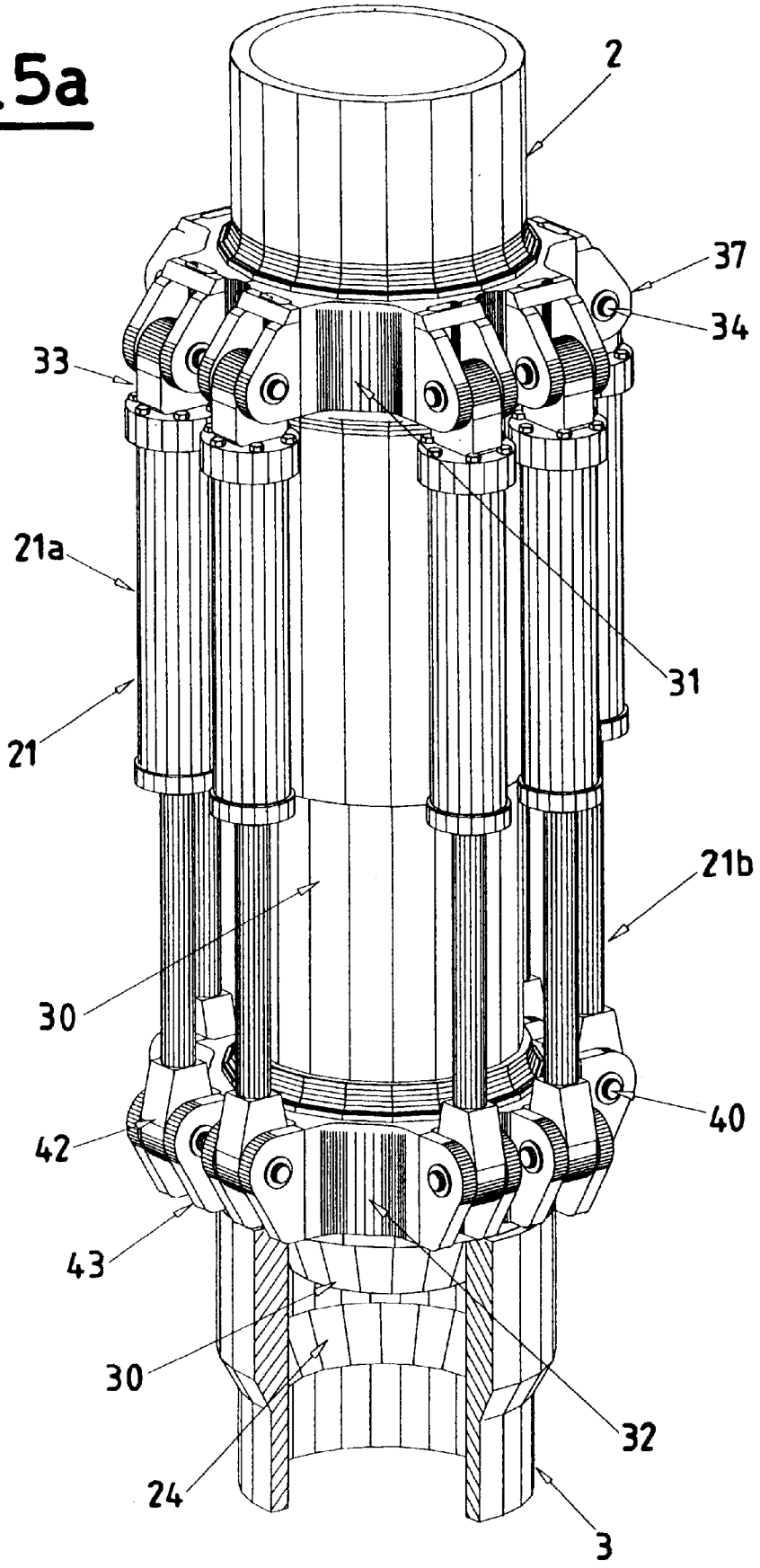
Figure 5B:
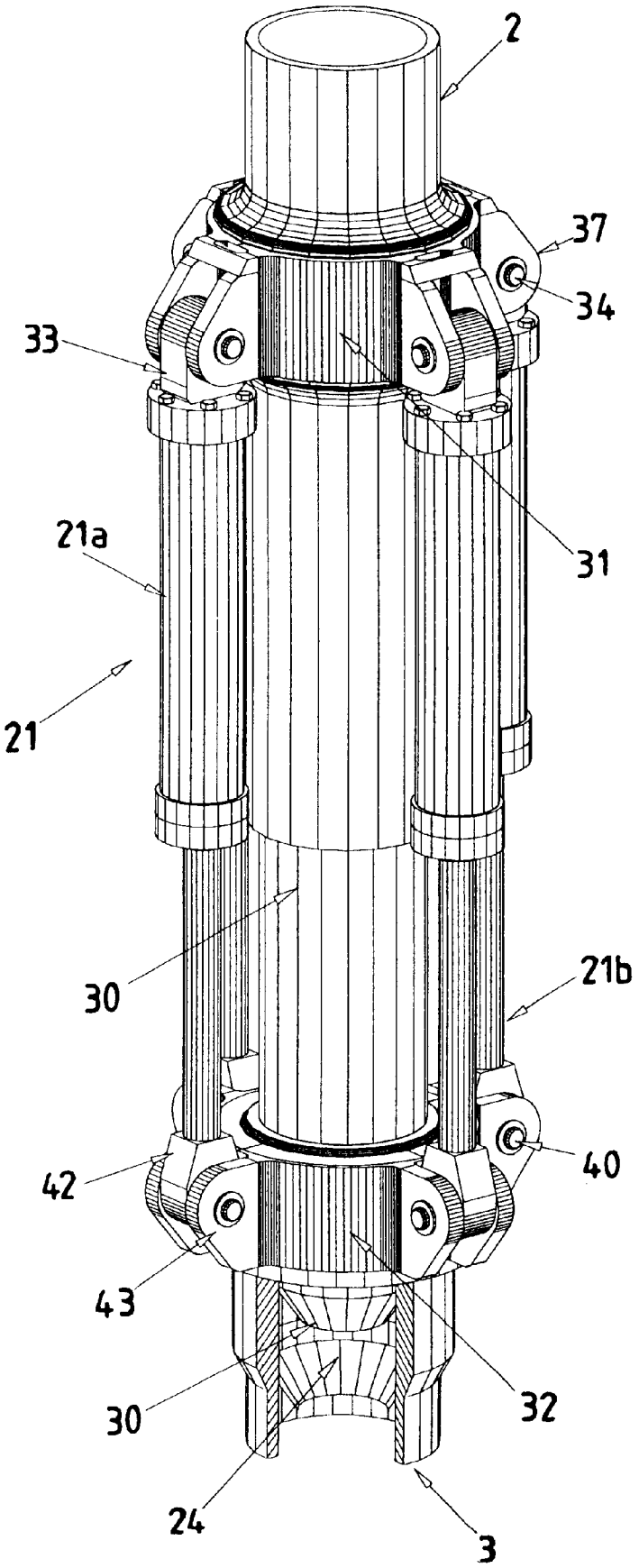
Figure 5C:
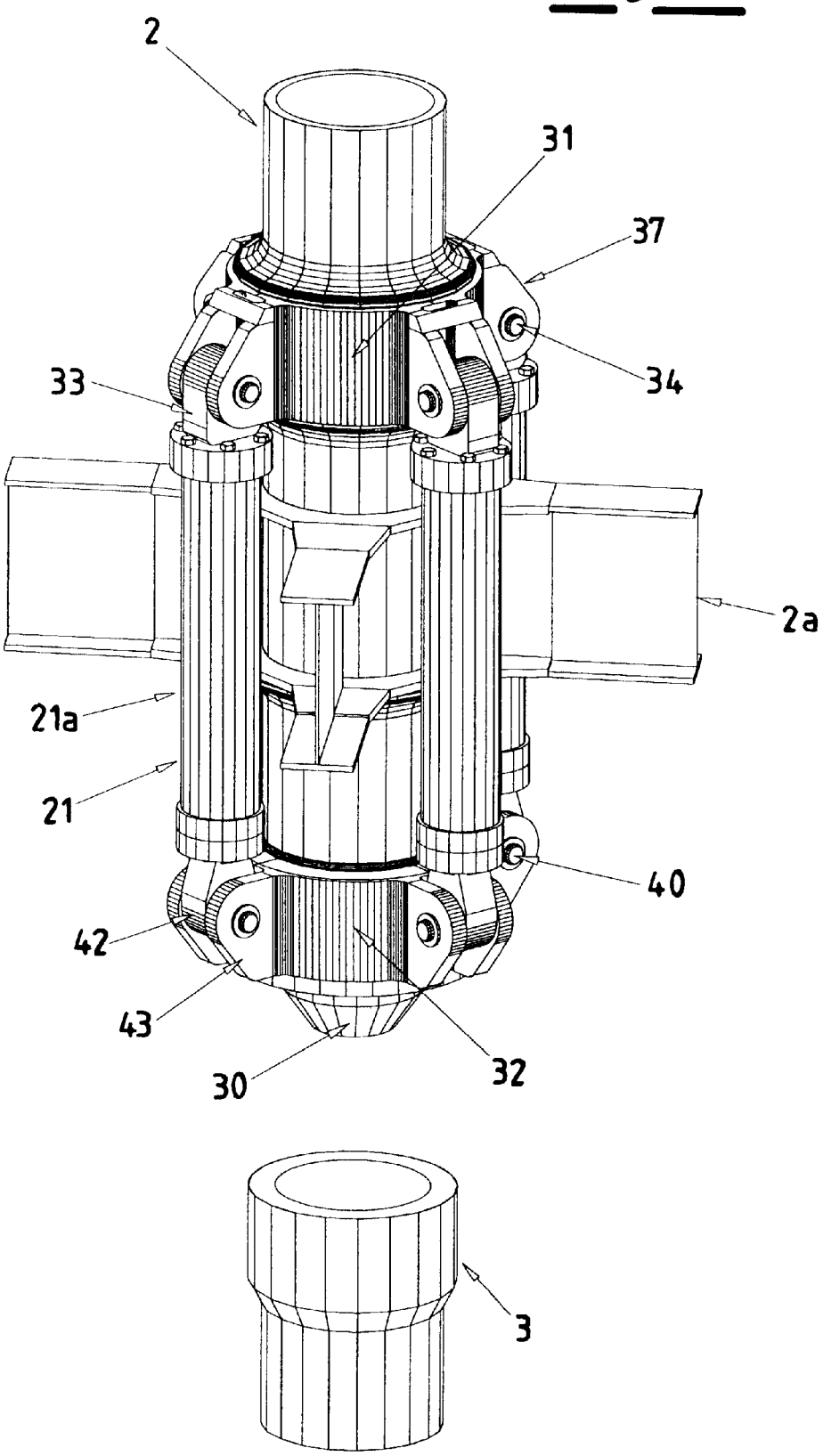
Figure 5D:
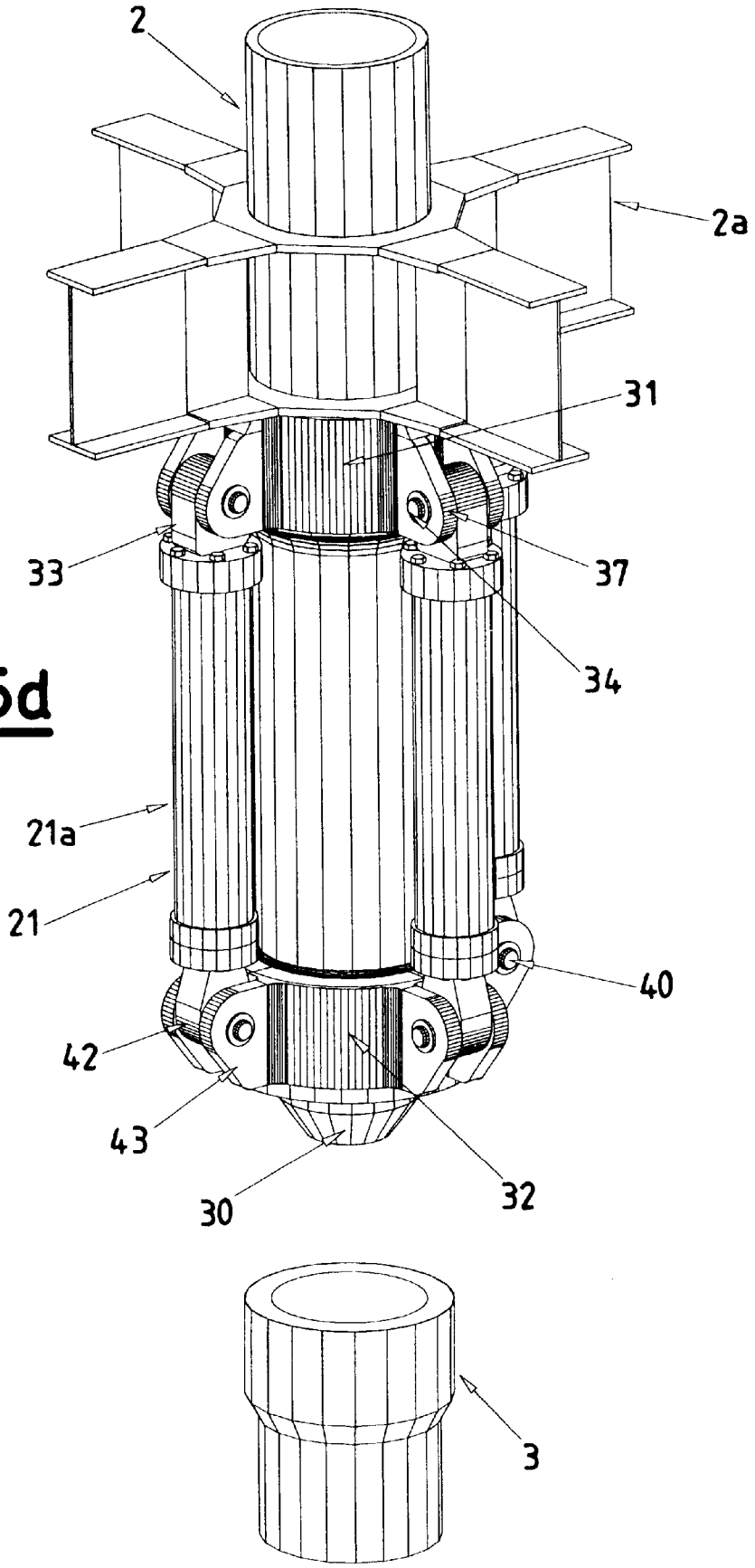
Figure 5E:
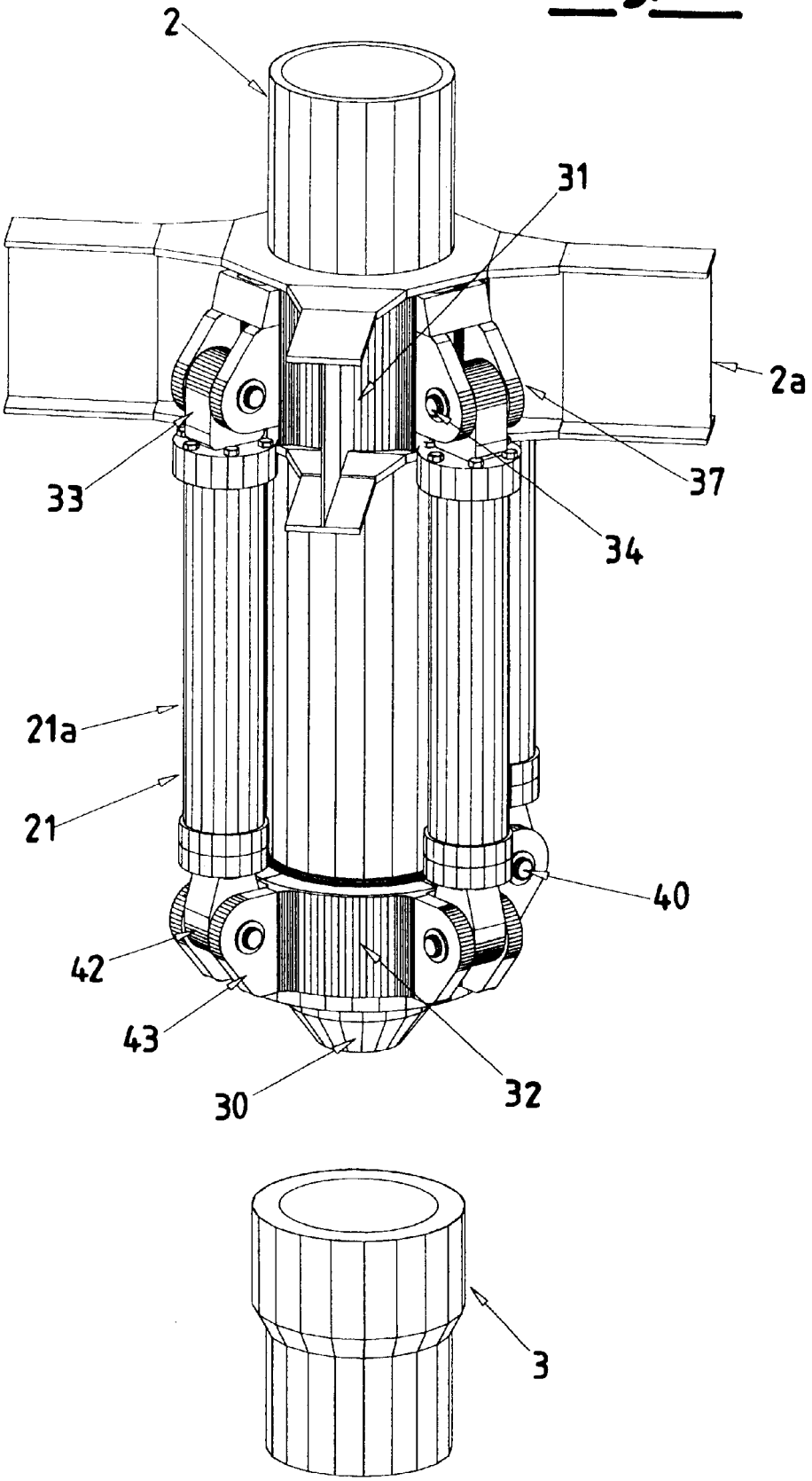

A second special joint 32 is an integral part of the actuated leg 30, where the inner part 42 of the hydraulic jack 21*b* (see FIG. 5*a*) is connected to the padear 43 by the pin 40.

FIGS. 5/*a* and 5/*b* depict the typical extended 4000 and 2000-ton configuration, respectively, of the ALS 21 in which the maximum stroke is indicated by the hydraulic jack 21*b*. The support plate 24 is fixed inside the leg of the substructure 3 at a predetermined height and receives, partially, the weight transferred by the actuated leg 30.

FIGS. 5/*c*, 5/*d* and 5/*e* illustrate the various arrangements of the ALS 21 which can be fixed, respectively, amidst, underneath and on the cellar deck main frame 2*a*.

It will be apparent to those skilled in the art that, as depicted in FIGS. 5/*a* and 5/*b* for purposes of illustration but not by way of limitation, the number of hydraulic jacks 21*a* and the shape of the special joints 31 and 32 may vary by case. FIGS. 5/*c*, 5/*d* and 5/*e* are arrangements intended to cover all alternatives and modifications to the system but not limited thereto.

Figure 6:
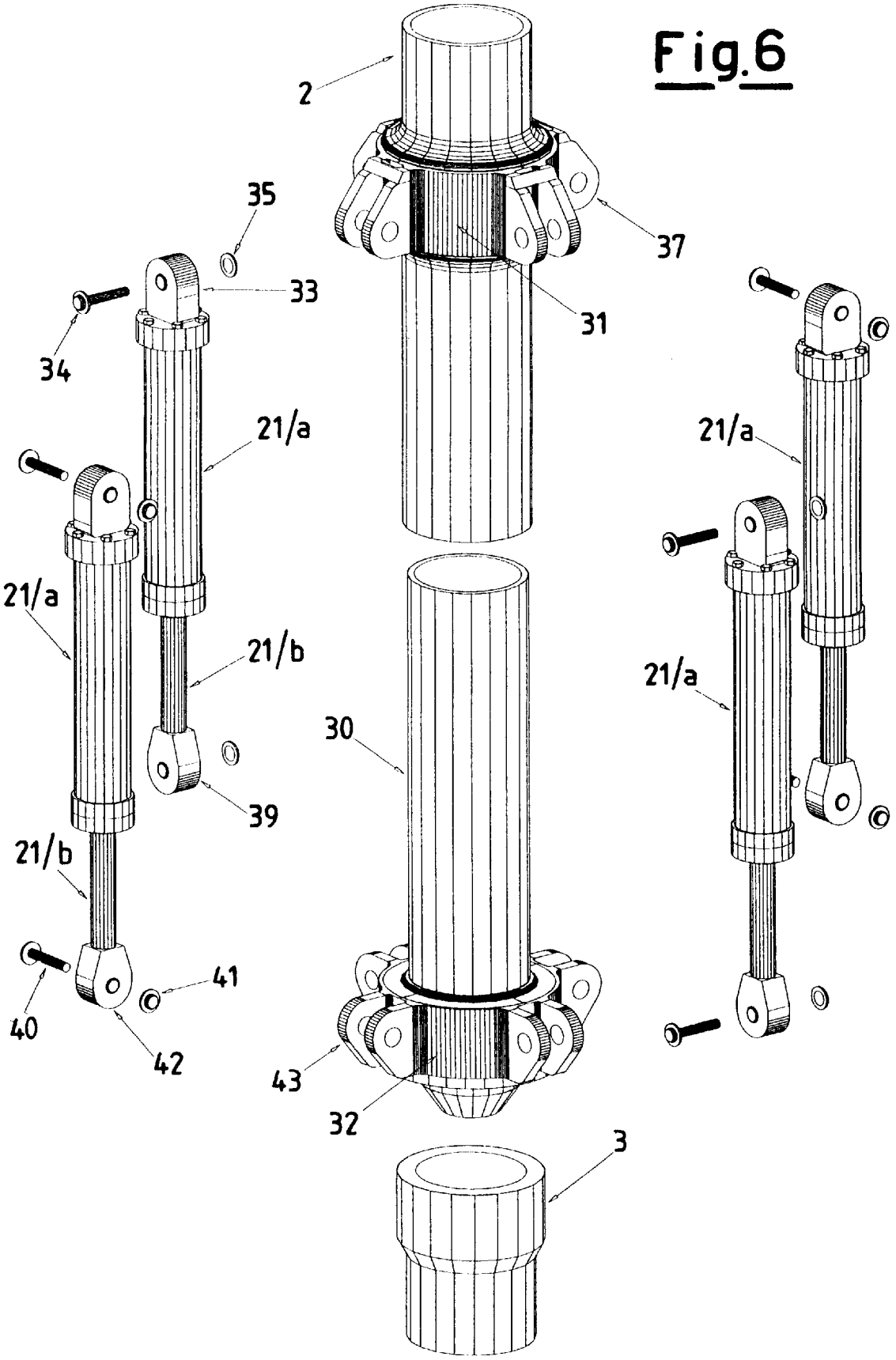
FIG. 6: is the activated leg exploded and detailed (ALS)
Figure 7A:
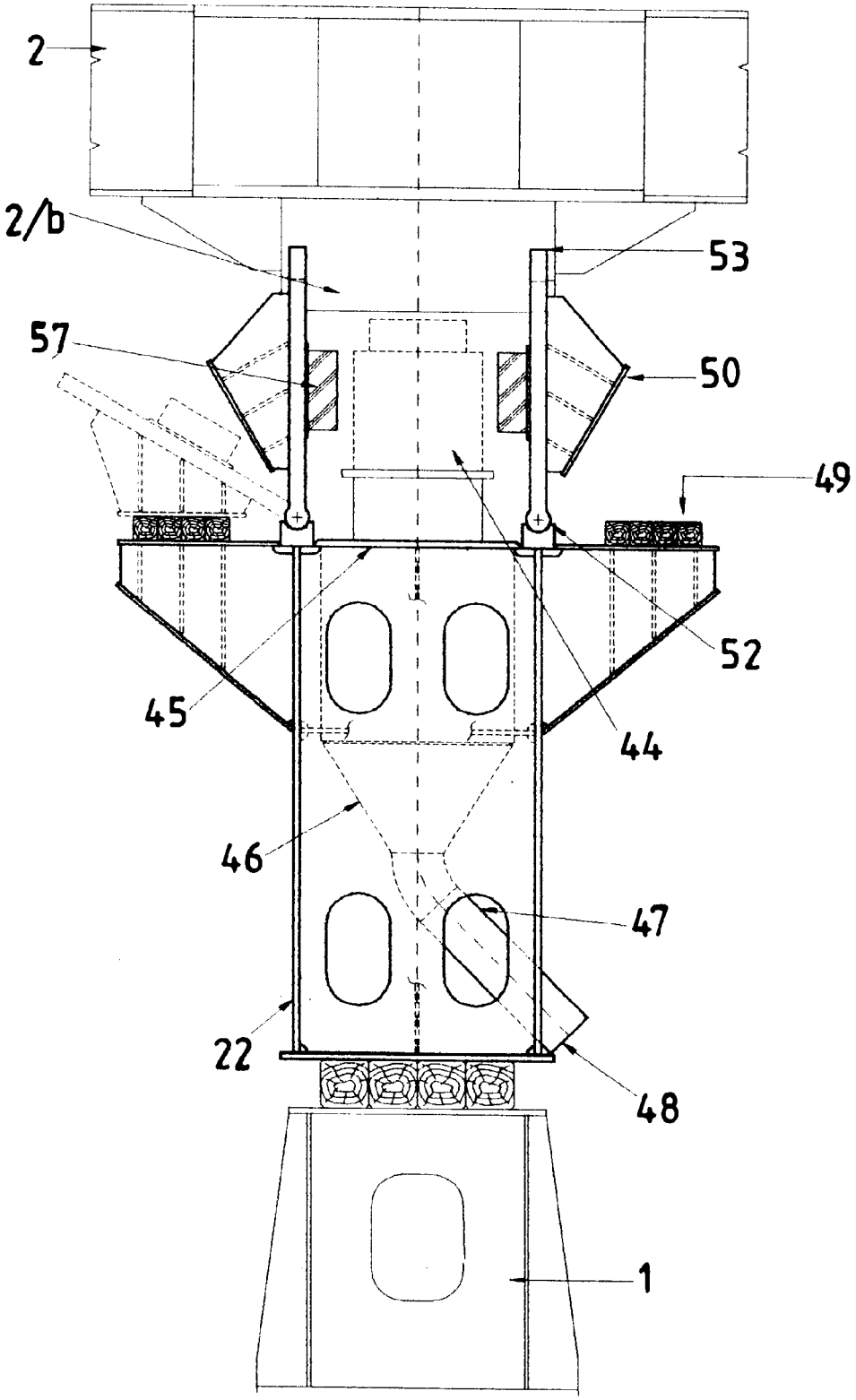
FIG. 7*a:* is the detailed cargo barge release system (BRS)
Figure 7E:
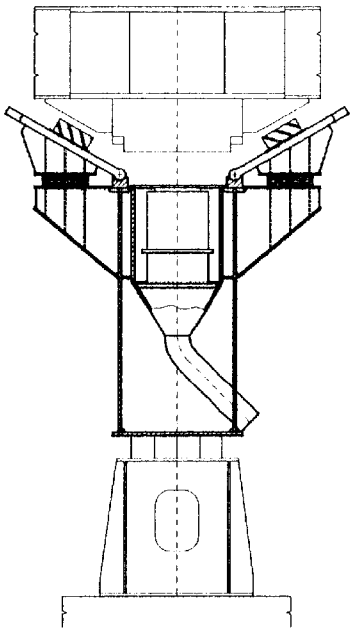
FIGS. 7/*b*, 7/*c*, 7/*d*, 7/*e*: show a step by step cargo barge release system (BRS)
Figure 7D:
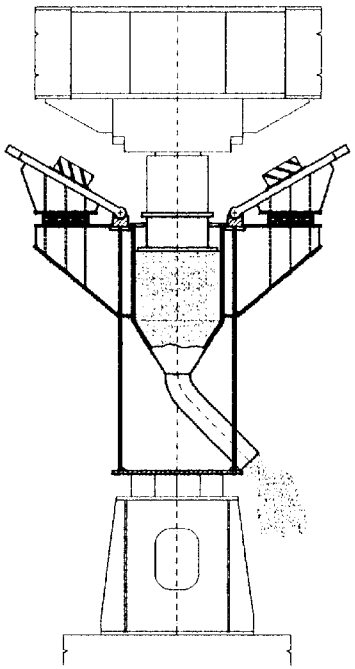
Figure 7C:
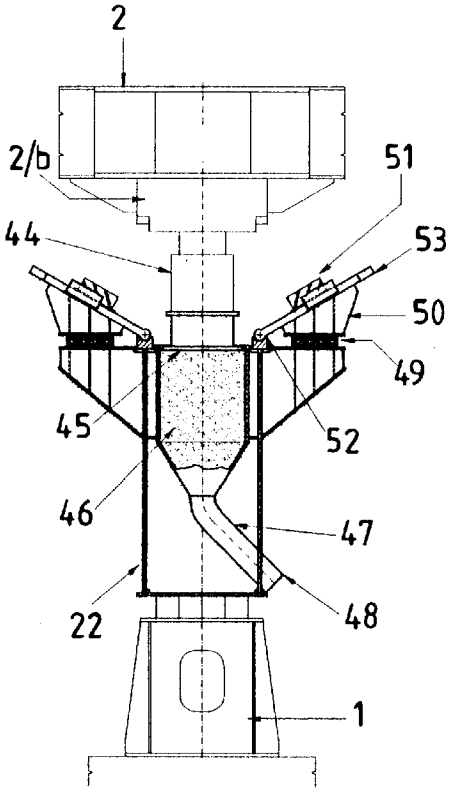
Figure 7B:
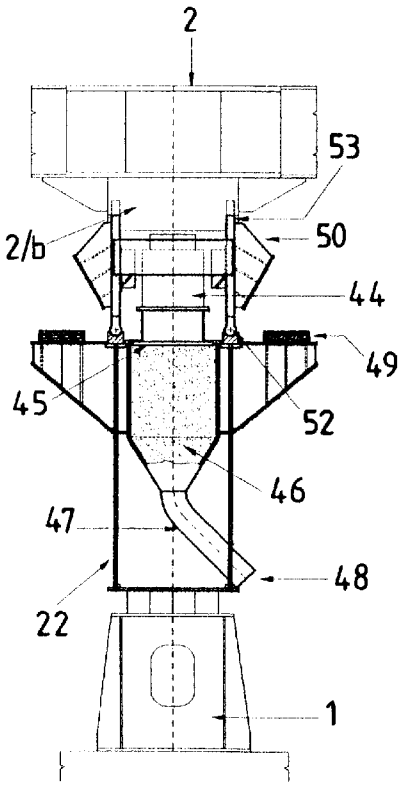
Figure 8:
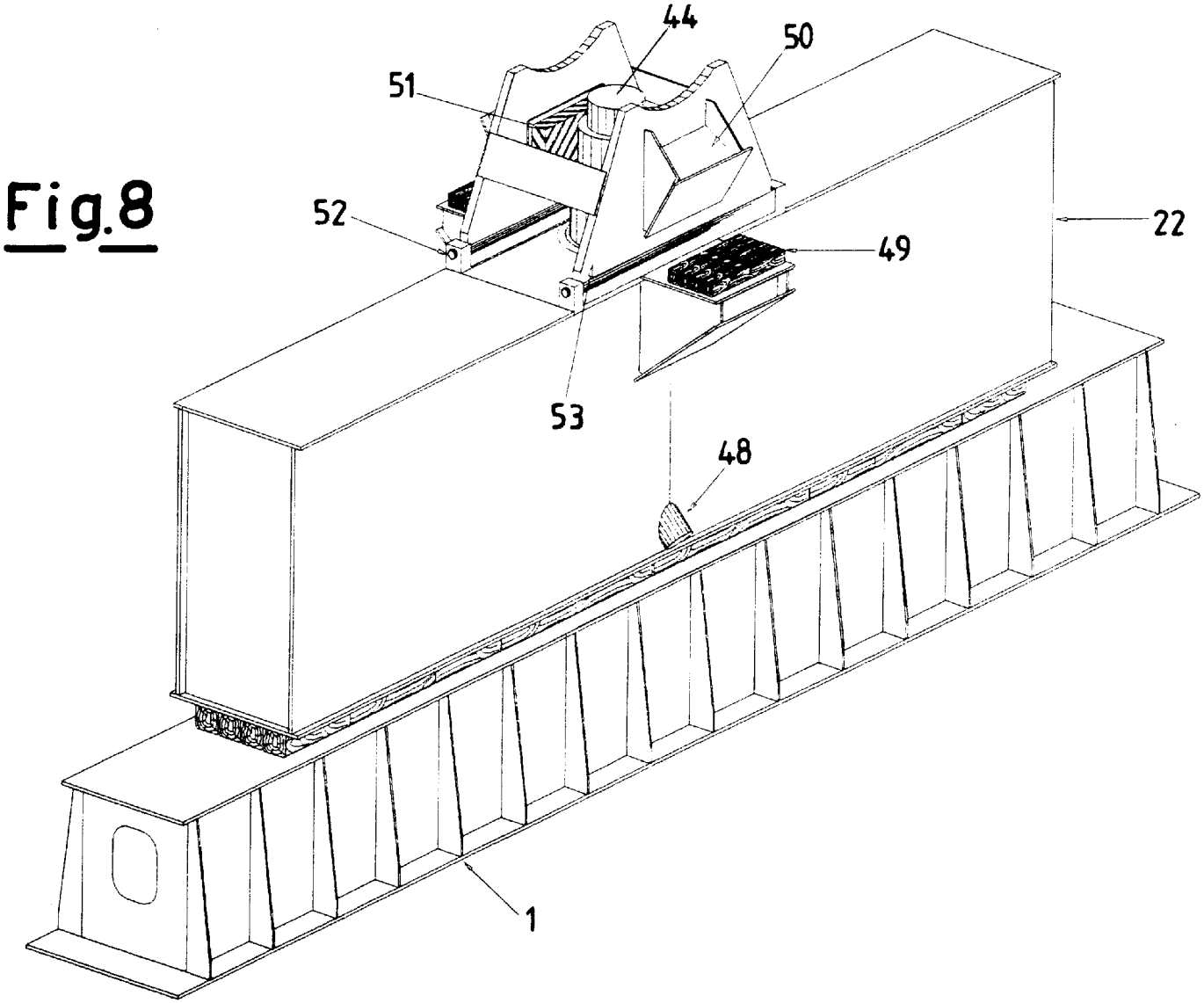
FIG. 8: is the assembly of the cargo barge release system (BRS)
Figure 8A:
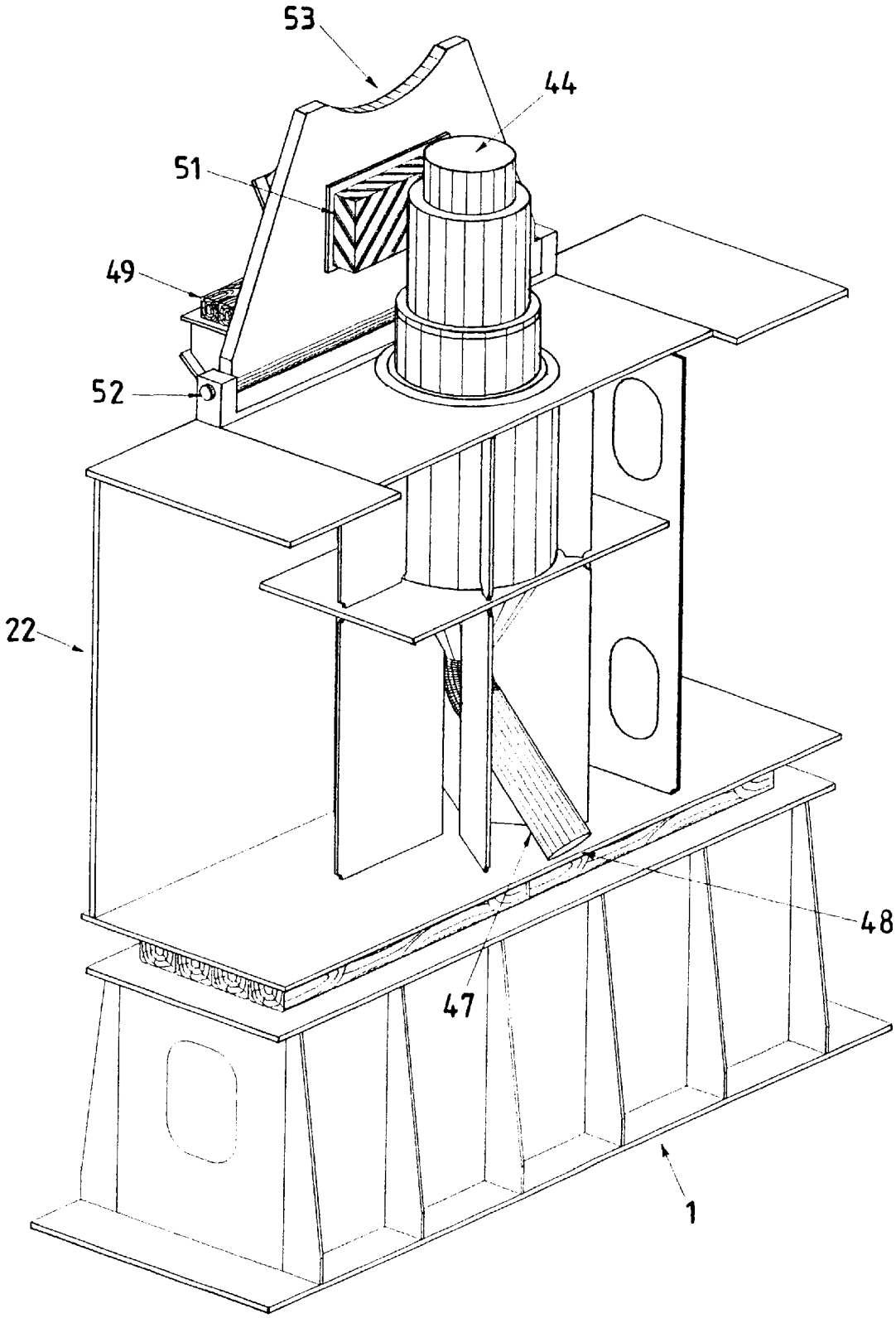
Figure 9:
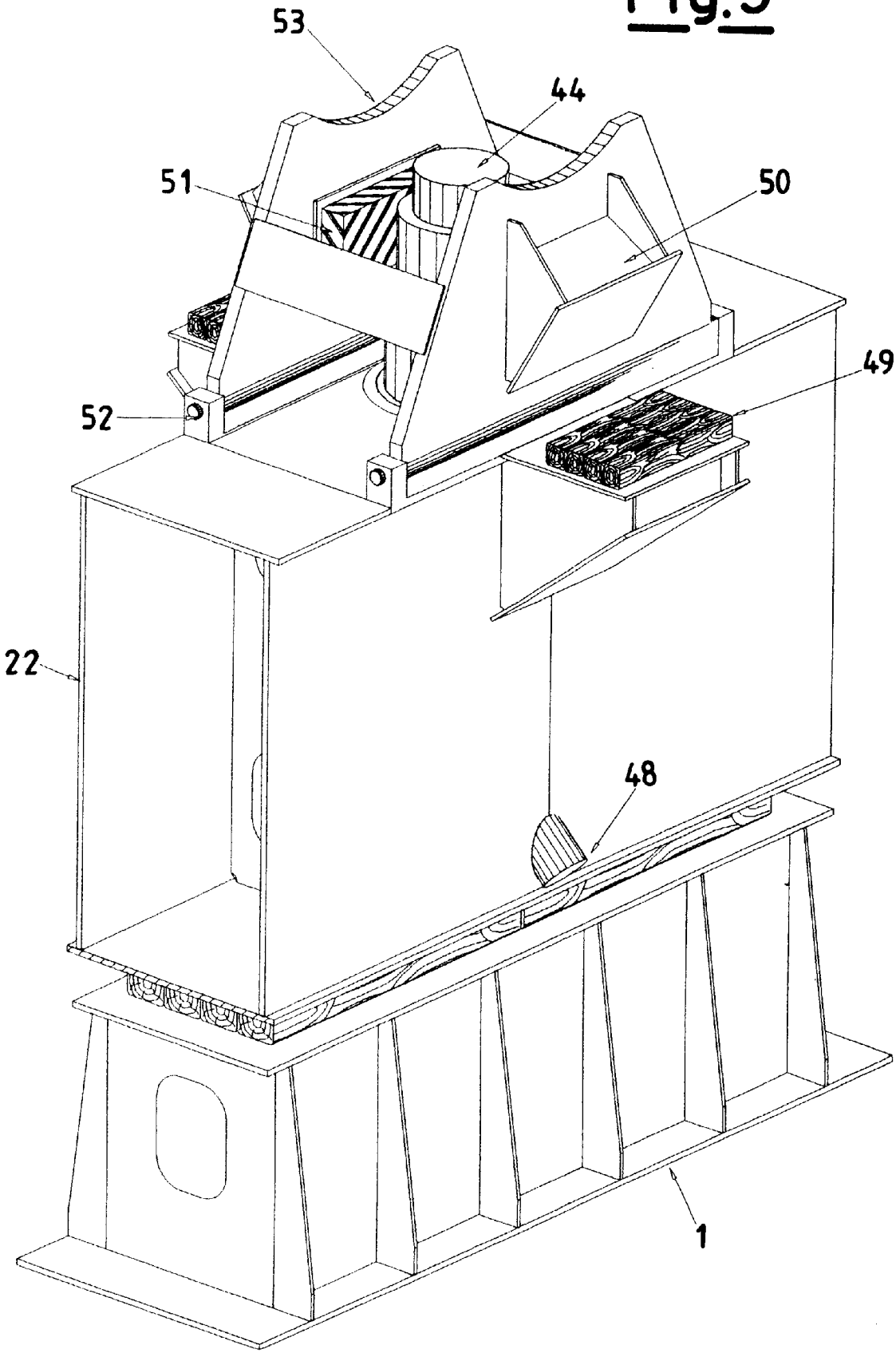
FIG. 9: is the cargo barge release system (BRS) in the ed transport position.
Figure 10:
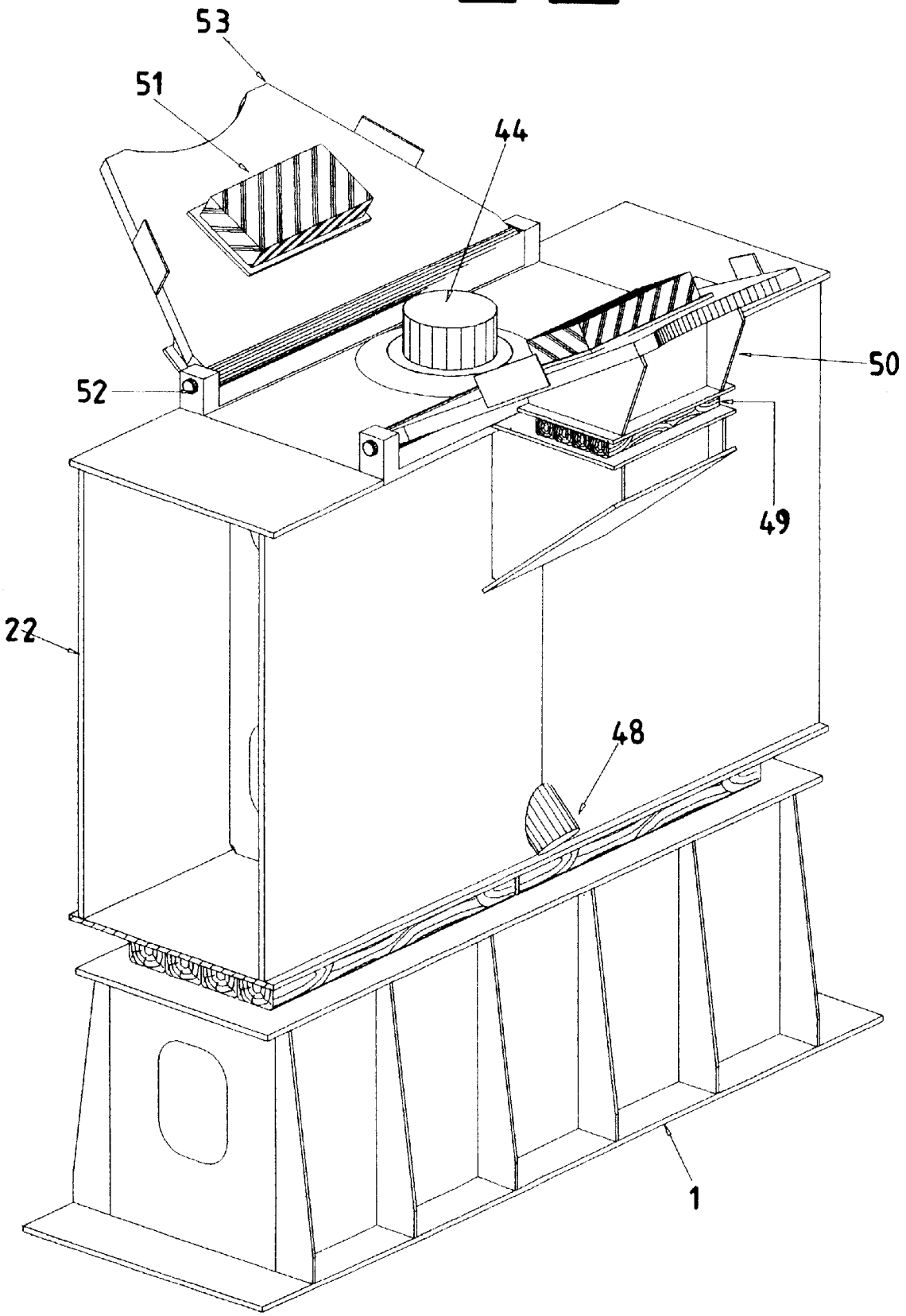
FIG. 10: is the cargo barge release system (BRS) in the open mating position.

Turning now to FIG. 6, in which ALS 21 is illustrated in detail, there is shown the load leg 2 with a special joint 31, shaped with a series of padears 37 into which the attachment part 33 is fixed with pin 34 and washer 35 of the upper part of the hydraulic jack 21/*a*. The actuated leg 30 slides inside the load leg 2 with a second special joint 32, shaped with a series of padears 43 into which the attachment part 42 is fixed with pin 40 and washer 41 of the inner part of the hydraulic jack 21/*b*.

No discussion is made here about the ALS jacks power pack 25 (see FIGS. 4 and 4/*a*) and the BRS jacks power pack 25/*a* (see FIGS. 4 and 4/*a*), as well as about the accelerator for the hydraulic jacks 25/*b* (see FIGS. 4 and 4/*a*), because it will be apparent to those skilled in the art that power packs and accelerators are components well known in the art.

Turning now to FIGS. 7/*b*, 7/*c*, 7/*d*, 7/*e*, 7/*a*, 8, 8/*a*, 9 and 10, where the secondary transfer or release system BRS 22 is illustrated, the cargo barge 1 has its standard skid way on top of which there is shown the release system BRS 22. There is also shown the load 2 with its underneath support 21*b* and an hydraulic jack 44 placed on top of a support plate 45. The assembly of the hydraulic jack 44 and support plate 45 is placed on top of an adequate sand hopper 46 which ends with a reduced pipe 47 and an opening valve 48, known to those skilled in the art, for the rapid over flow of the sand. During the transport, the hydraulic jack 44 is in the retracted position and the load 2, with its underneath support 2/*b*, sits on the support plate 53.

When the cargo barge 1 is in the mating configuration (see FIG. 4), the ALS 21 is actively transferring, jointly with the barge ballasting, the majority of the weight of the load 2 on the legs of the substructure 3. Thereafter the hydraulic jack 44 is activated to extend for a minimum stroke in order to release the support plates 53, which will rotate on the hinged pins 52. When the bumper parts 50 will impact the hard timber absorber 49, the release system BRS is ready in the mating configuration.

Rubber or any other resilient material known to those skilled in the art is used for the impact absorber 51.

Referring now to FIGS. 11/*a*, 11/*b*, 11/*c* and 12/*a*, 12/*b*, 12/*c*, where there are depicted the alignment side fenders and stoppers, the cargo barge 1 has been docked automatically inside the slot of an eight-legged substructure 3, with the load legs 2 corresponding with the substructure legs 3/*a*, 3/*b*, 3/*c*, 3/*d*.

Figure 12A:
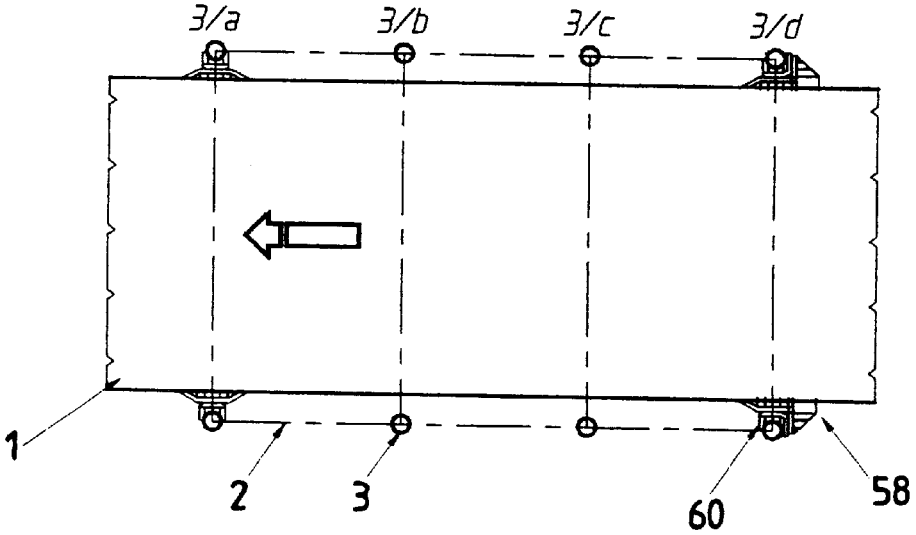
FIG. 12/*a*: is a general view of the mating alignment fender and stopper.
Figure 12B:
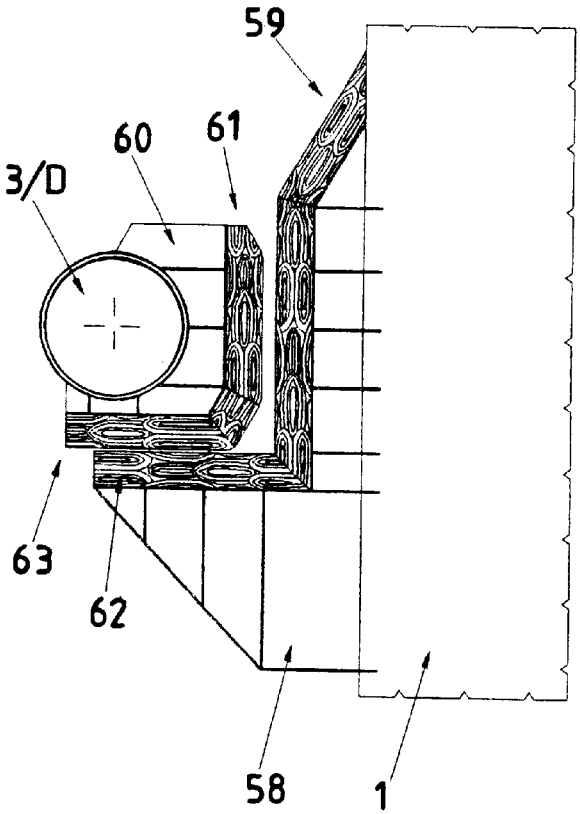
Figure 12C:
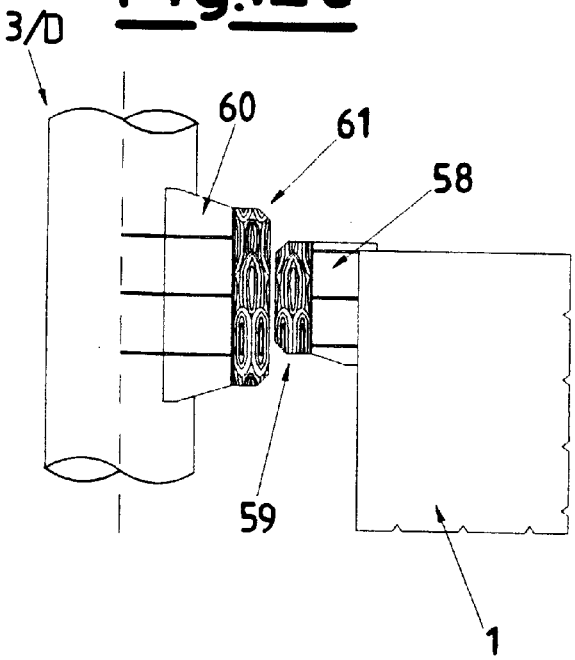

On the cargo barge 1, the fender assembly 54 of FIG. 11/*a* and the fender assembly 58 of FIG. 12/*a* are on two different elevations to optimise the fendering system. The hard timber 55 of FIG. 11/*b* and the hard timber 59 of FIG. 12/*b* will absorb any impact between cargo barge sides and substructure legs 3/*a* and 3/*d* in the mating configuration, thus reducing and/or eliminating any side motion, in combination with the respective substructure leg assembly 56 of FIG. 11/*c* and the leg assembly 60 of FIG. 12/*c* with their respective hard timber protection 57 and 61.

While maneuvering inside the slot of the substructure 3 using the mooring system 8, 8/*a* and 8/*b* (see FIG. 1) with the assistance of the leading tugs 4 and 6 (see FIG. 1), the cargo barge 1 will conclude the maneuver automatically when the hard timber protection 62 seen in FIG. 12/*b* will bump against the hard timber protection 63 of the substructure legs 3/*d*, thus reducing and/or eliminating any longitudinal motion.

It will be apparent to those skilled in the art that, as depicted in FIGS. 11/*a*, 11/*b*, 11/*c* and 12/*a*, 12/*b*, 12/*c* for purpose of illustration but not by way of limitation, the fender assemblies 54, 56, 58 and 60, may vary according to the necessity of the case and the shape of the hard timbers 62 and 63 may vary for other suitable arrangements, thus providing the automatic mating configuration. Meanwhile, the protectors 55, 57, 59, 61 may be composed of other reliable materials well known to the skilled person in the art.

I claim:

1. Apparatus to transfer, at sea, a load onto fixed legs of a substructure emerging from water, said load being specially fabricated in a construction yard and transported to the substructure by a cargo barge, said load and substructure having a corresponding number of legs, said apparatus comprising:

(a) a prelaid mooring arrangement laid out in front of the substructure emerging from water and having a horizontal sheave that is opened to shift a mooring wire from one position to another;

(b) a device aligned to mate the load to the substructure, said device including:

(b') a main transfer connector, called ALS, installed on the legs of the load; and (b") a secondary transfer connector or cargo barge release, called BRS, installed on the cargo barge;

(c) protective fenders secured to sides of the cargo barge and to the fixed legs of the substructure; and (d) a cargo barge arrest assembly arranged on the fixed legs of the substructure and the cargo barge.

2. Apparatus according to claim 1, wherein said load is any kind of structure, integrated module or deck, built in the construction yard, and wherein said substructure is any kind of structure, fixed or anchored to a bottom of the sea.

3. Apparatus according to claim 1, wherein said cargo barge is any kind of floatable structure prepared to transport said load and equipped with ballast.

4. Apparatus according to claim 1, wherein the main transfer connector called ALS (b') further includes:

($b'_1$) a first joint on the legs of the load;

($b'_2$) an actuated leg slidable inside the legs of the load with a second joint at a lower extremity of the actuated leg for mating with the legs of the substructure; and ($b'_3$) a plurality of hydraulic jacks, said hydraulic jacks being present in proportional number with respect to a weight of the load.

5. Apparatus according to claim 1, wherein the secondary transfer connector called BRS (b") further includes:

($b''_1$) two support plates on which the load sits for transport, said support plates being hinged in an inner part for automatic release;

($b''_2$) a damping resilient material on the inner part of the support plates ($b''_1$);

($b''_3$) a hydraulic lifting jack placed on another support plate; and ($b''_4$) a sand hopper ending with an opening valve for rapid flow-out of sand, said sand hopper having a top on which there are placed the hydraulic lifting jack and the other support plate ($b''_3$).

6. Apparatus according to claim 1, wherein the fenders protect, locally or totally, the sides of the cargo barge and the legs of the substructure, said fenders being constituted by hard timber or other material to absorb impact loads.

7. Apparatus according to claim 1, wherein the cargo barge arrest assembly is composed of hard timber or other material to absorb impact loads.

8. Apparatus according to claim 1, wherein the fenders and the cargo barge arrest assembly permit, jointly, automatic alignment of the legs of the load on the cargo barge with the legs of the substructure.

9. Process to transfer, at sea, a load onto fixed legs of a substructure emerging from water, said load specially fabricated in a construction yard and transported to the substructure by a cargo barge, said process comprising the steps of:

(1) maneuvering the cargo barge on which, in the construction yard, the load has been transferred and seafastened in a final transportation configuration, on a preinstalled grillage, inside a slot of the substructure, in such a way that alignment of legs of the load and legs of the substructure is automatic;

(2) activating hydraulic jacks in such a way that an activated leg slidable inside the legs of the load mates with the legs of the substructure by closing a hydraulic circuit so that weight of the load will be transferred partially to the substructure;

(3) activating ballast on the cargo barge while a hydraulic lifting jack on a support plate is raised jointly with the hydraulic jacks in such away so as to release two other support plates on which the load sits at a nonreturn point;

(4) opening a valve for flow-out from a sand hopper jointly with raising of the hydraulic jacks in such a way to transfer all the weight of the load onto the legs of the substructure, while keeping the ballast on the cargo barge always running in such a way so as to further lower the cargo barge in order to have a safe exit from the substructure;

(5) lowering totally, once the cargo barge is out of the slot of the substructure, the hydraulic jacks on the legs of the substructure; and (6) removing the hydraulic jacks jointly with the hydraulic circuit and welding bevels on the legs of the substructure.

10. Process according to claim 9, further comprising at the end of step (5), after the cargo barge is out of the slot of the substructure, the step of unmooring said cargo barge and returning to the construction yard.

11. Process according to claim 9, further comprising, during step (2), the step of stroking the hydraulic jacks so as to assure partial transfer of the load onto the substructure.

* * * * *